US005136836A

United States Patent [19]

Lossa et al.

[11] Patent Number: 5,136,836

[45] Date of Patent: Aug. 11, 1992

[54] APPARATUS FOR REFILLING A YARN LUBRICATING HEAD DEVICE UTILIZED IN EACH SPINDLE ASSEMBLY OF A TEXTILE YARN PROCESSING MACHINE

[75] Inventors: Ulrich Lossa, Krefeld; Heinz Stenmans, Grefrath, both of Fed. Rep. of Germany

[73] Assignee: Palitex Project Company GmbH, Krefeld, Fed. Rep. of Germany

[21] Appl. No.: 549,891

[22] Filed: Jul. 9, 1990

[30] Foreign Application Priority Data

Jul. 24, 1989 [EP] European Pat. Off. ..... 89113548

[51] Int. Cl.[5] ..... D01H 7/86

[52] U.S. Cl. ..... 57/296; 57/58.83

[58] Field of Search ..... 57/264, 295, 296, 297, 57/58.49, 58.83

[56] References Cited

U.S. PATENT DOCUMENTS

| | | | |
|---|---|---|---|
| 3,295,305 | 1/1967 | Nimtz | 57/296 X |
| 3,864,901 | 2/1975 | Beymes et al. | 57/296 |
| 4,498,283 | 2/1985 | Kodama et al. . | |
| 4,573,314 | 3/1986 | Lorenz | 57/296 |
| 4,641,493 | 2/1987 | Fukunaga | 57/296 |
| 4,759,175 | 7/1988 | Inoue | 57/296 |

FOREIGN PATENT DOCUMENTS

| | | |
|---|---|---|
| 8116261 | 9/1982 | Fed. Rep. of Germany . |
| 3824998 | 2/1989 | Fed. Rep. of Germany . |

*Primary Examiner*—Joseph J. Hail, III

*Attorney, Agent, or Firm*—Bell, Seltzer, Park & Gibson

[57] ABSTRACT

The invention relates to an operating apparatus for the automated refilling of a lubricating head with a wetting agent, which is inserted on a package adapter placed on the hollow shaft of a two-for-one twisting spindle. To this end, a maintenance automat traveling to the two-for-one twisting spindle to be serviced is provided, which comprises a gripper adapted to swing out of the maintenance automat and to move upward and downward, so as to remove the lubricating head from the region of the two-for-one twisting spindle and to connect same with a refilling station located in the maintenance automat.

8 Claims, 5 Drawing Sheets

APPARATUS FOR REFILLING A YARN LUBRICATING HEAD DEVICE UTILIZED IN EACH SPINDLE ASSEMBLY OF A TEXTILE YARN PROCESSING MACHINE

FIELD, BACKGROUND AND OBJECT OF THE INVENTION

Two-for-one twisting spindles are often provided with yarn moistening devices in the form of a lubricating head inserted on the hollow spindle shaft with a package adapter interposed. Such a lubricating head comprises a tank filled with a wetting agent and a porous wetting body with a capillary action, along which the yarn passes to receive the wetting agent, which is supplied from the tank to the wetting body from the bottom by suction.

Since this method consumes a wetting agent, it is the object of the present invention to refill the tank of the lubricating head with the wetting agent by an automated apparatus.

This object is accomplished by providing a refilling device for a yarn lubricating head device in a textile yarn processing machine having a plurality of spindle assembly stations in side-by-side relationship along the length of the machine for processing of yarn at each station. Each spindle assembly includes an adapter device carrying at least one yarn supply package and being removably mounted along the spindle assembly axis for supplying yarn to be processed and a yarn lubricating head device removably mounted on the adapter device along the spindle assembly axis and having a storage tank for containing a lubricating agent and a porous wetting body extending into said tank for absorbing the lubricating agent by capillary action and being positioned for receiving the yarn as it is being processed and applying the lubricating agent to the yarn. A maintenance device travels to a respective spindle assembly station after a supply package of yarn has been processed, removes the adapter device with a substantially empty yarn supply package thereon from the spindle assembly station and places one of the adapter devices with a full yarn package in the spindle assembly station for subsequent yarn processing.

The device for refilling the lubricating head device with lubricating agent in accordance with this invention is positioned within the maintenance device. Means are also carried by the maintenance device for removing the lubricating head device from the adapter device, carrying the lubricating head device into the maintenance device and positioning the lubricating head device in the refilling means, and for subsequently removing the lubricating head device from the refilling means after refilling thereof, carrying the lubricating head device to the spindle assembly station and positioning the lubricating head device on the adapter device which now has a full yarn supply package thereon.

The refilling means includes a supply tank for containing lubricating agent and valve means opening into the supply tank. The lubricating head device further includes valve means opening into the storage tank and cooperating with the valve means of the refilling means for allowing the flow of lubricating agent from the supply tank to the storage tank. The valve means of the refilling means and the valve means of the lubricating head device comprise respective male and female valve members in the form of a movably mounted protruding tube in the refilling means valve means and a movably mounted hollow member in the lubricating head device valve means. The valve means of the refilling means and the valve means of the lubricating head device each include spring means biasing the respective male and female valve members into their closed positions.

The refilling means preferably includes a compressed-air inlet on the supply tank for receiving a compressed air line to supply compressed air to the supply tank for pressurizing the lubricating agent therein. The lubricating head device preferably includes a pressure relief valve on the storage tank for relieving pressure in the storage tank during filling thereof.

The lubricating head device and the refilling means preferably further include cooperating mounting guide means for mounting the lubricating head device in desired position on the refilling means. These cooperating mounting guide means may include a connecting tube means extending from the lubricating head device which is normally used for mounting the lubricating head device on the adapter device, and a complementary receptacle in the refilling means for receiving the connecting tube means.

BRIEF DESCRIPTION OF THE DRAWINGS

The invention will be described below in greater detail with reference to the drawing, in which.

DETAILED DESCRIPTION OF PREFERRED EMBODIMENT OF THE INVENTION

Figure 1:
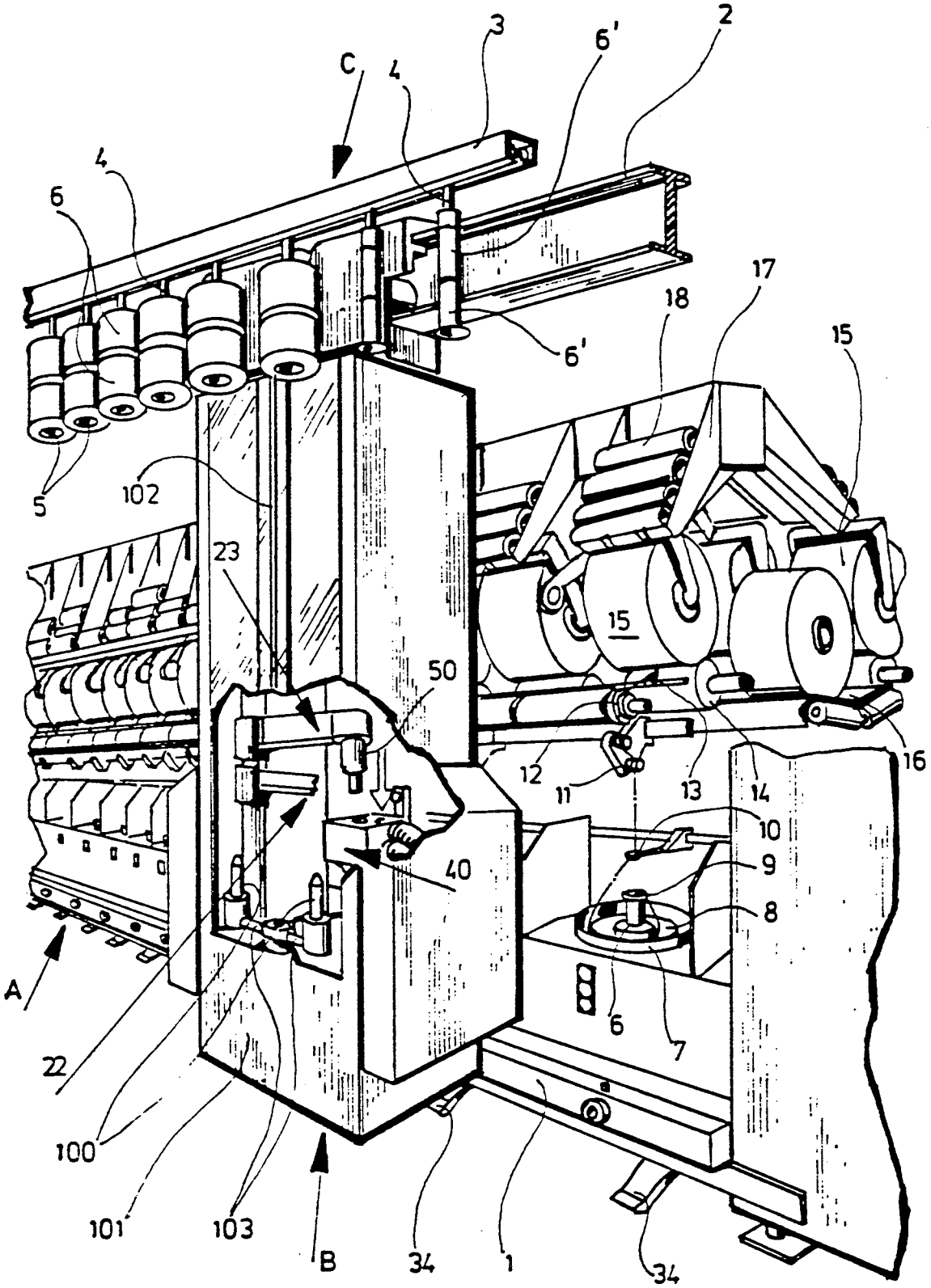
FIG. 1 is a perspective view of portions of a two-for-one twister with a maintenance automat traveling along this machine.

FIG. 1 shows a portion of a two-for-one twister A, a maintenance automat B traveling along the two-for-one twister on lower and upper rails 1 and 2, and an overhead conveyor C.

The overhead conveyor C comprises an upper rail 3, along which a conveyor chain or belt extends with evenly-spaced apart, downward directed suspension holders 4 attached thereto for accommodating package adapters or package transport adapters 5. The suspension holders 4 and the package adapters 5 are constructed in known manner, so that during a first upward movement of the package adapter 5, the latter is grasped and held by the suspension holder 4. FIG. 1 shows in the region of the upper rail 3, on the left side, six package adapters 5, each loaded with two fully cross-wound packages 6, which are to be delivered by the maintenance automat B to the individual twisting positions of the two-for-one twister A, and on the right side, two package adapters 5, each holding two empty tubes 6', which were individually removed by the maintenance automat B from the twisting positions of the two-for-one twister A and delivered to a suspension holder 4. These tubes 6' are transported together with the package transport adapters 5 by means of the overhead conveyor C to an external loading station, where the adapters 5 can again receive fully wound yarn packages or feed yarn packages 6.

The two-for-one twister A comprises several working or twisting positions with the known standard elements, such as a spindle pot (not shown) in the lower portion, balloon limiter 7, protective pot 8, yarn inlet end 9, balloon yarn guide 10, deflecting elements 11 for controlling the yarn winding tension, overfeed element 12, traversing yarn guide 13, and a cross-wound package of the twisted yarn or takeup package 15, which is driven by a friction roll 14. In the center of the machine, a conveyor belt 16 extends in the upper region between the two parallel, longitudinal sides of the machine for the removal of fully wound twister packages 15. Located above each cross-wound twister package or takeup package 15 driven by friction roll 14, is a magazine 17 for empty tubes 18.

Shown inside the protective pot 8 is an upper, only partially cross-wound package or feed yarn package 6 of a pair of feed yarn packages inserted into the twisting position by means of an adapter 5. From the feed yarn packages, the yarns are withdrawn upward and guided through the yarn inlet end 9 into the lower spindle portion to a yarn storage disk, whence the two combined yarns advance to balloon yarn guide 10 while forming a yarn balloon, and subsequently, after passing deflection rolls 11 and overfeed roll 12, onto a takeup package 15, which is driven by the friction roll 14.

The maintenance automat B routinely travels in front of the two-for-one twister A or its individual twisting positions. FIG. 1 schematically illustrates portions of the various handling elements of the automat B, which serve to replace package adapters 5 loaded with empty winding tubes 6' (unwound unit) with package adapters 5 carrying fully cross-wound packages 6 (feed yarn unit), and to handle or secure the yarn ends of the empty or almost unwound tubes 6'. These elements are primarily two mandrels 100 to receive the feed yarn or unwound units, which are adapted to rotate about a vertical axis and to move upward and downward in vertical direction, as well as gripper and suction devices 22 and 23.

The maintenance automat B comprises a cabinet-shaped housing 101, whose front wall is provided with a guide slot 102 for a rotatable cross arm 103, which carries a mandrel 100.

Figure 2:
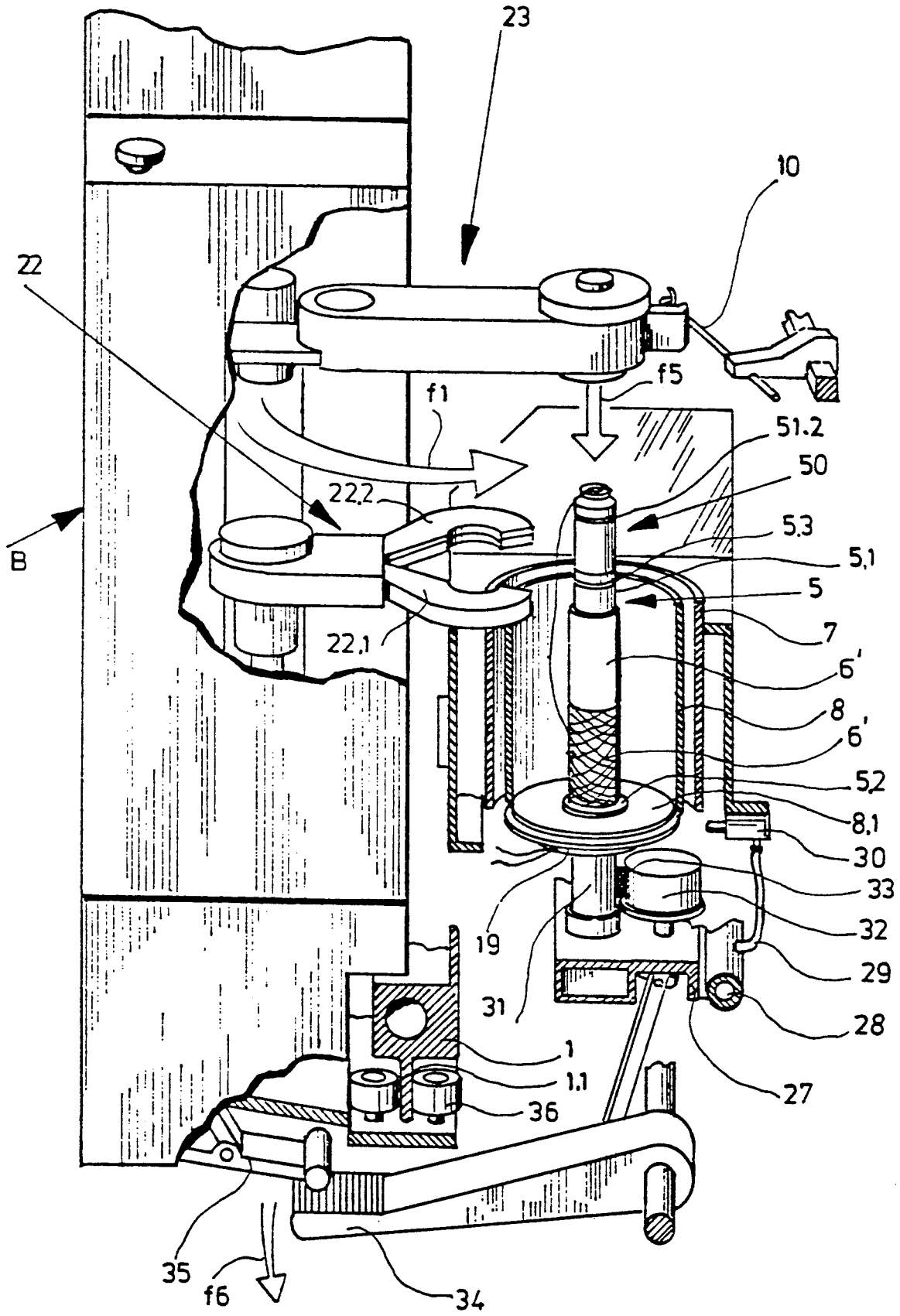
FIG. 2 is a partially sectional and partially perspective view of a two-for-one twisting spindle with a maintenance automat and its associated servicing and handling elements.

FIG. 2 shows in addition the bottom 8.1 of the protective pot of a two-for-one twisting spindle, as well as a standard yarn storage disk 19. The package adapter 5 which, as described above, is simultaneously a transport adapter, comprises a cylindrical portion 5.1, which is provided with a carrying flange 5.2 at its lower end, and preferably with an annular groove 5.3 in the region of its upper end. A lower gripper 22 of the maintenance automat B, which is adapted to move upward and downward, and to rotate in horizontal direction (arrow f1), and which is provided with two arms 22.1 and 22.2, serves to remove an unwound unit from the two-for-one twisting spindle. The ends of the two gripper arms 22.1 and 22.2 are able to tightly embrace the package adapter 5, which is inserted into the spindle pot 8, on its outer circumference, preferably however, in the region of its annular groove 5.3, thereby automatically clamping and securing at the same time the yarn end, which advances from the lower tube 6' not yet fully unwound, and enters into the hollow shaft of the package adapter. When removing a package adapter 5 from the protective pot 8 by the upward movement of gripper 22, it is necessary to see to it that the yarn end can be pulled out unobstructed from the hollow shaft of the spindle by the automatic opening of a yarn brake, which is arranged in known manner inside the hollow shaft of the two-for-one twisting spindle.

Figure 3:
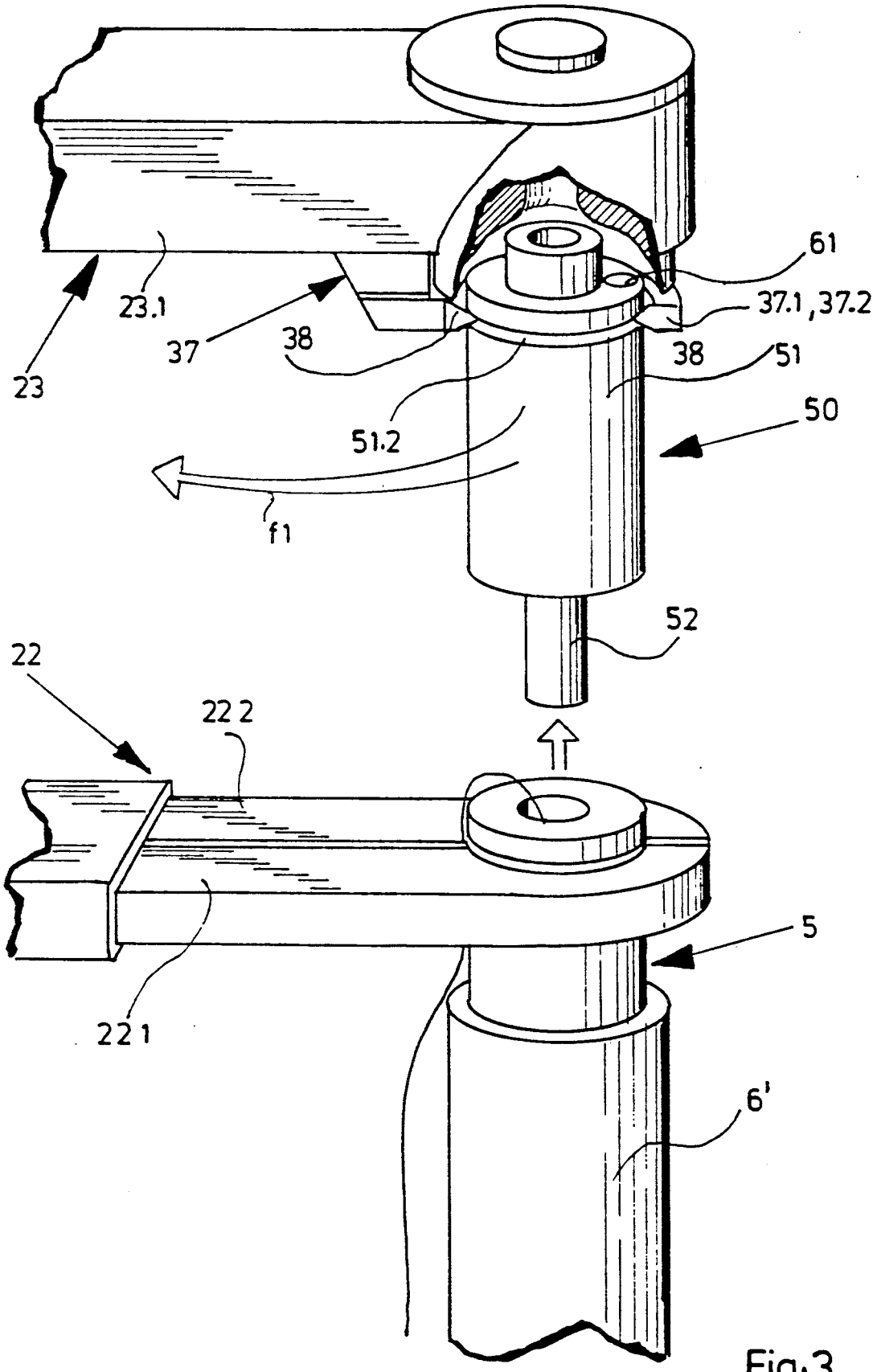
FIG. 3 is a schematic, perspective view of details of a lower gripper and an upper gripper associated to a suction device.

As is shown in FIGS. 2 and 3, the description proceeds from a bipartite package adapter. The lower portion of the adapter is a transport means for the fully wound packages or unwound tubes. In this form, the adapter is also a part of a package transport system superposed on the two-for-one twister. In the two-for-one twisting spindle, i.e., inside its protective pot, such a lower adapter portion serves at the same time to center the packages on the hub of the protective pot.

Inserted on this lower adapter portion 5 is a head piece or upper adapter portion 5' comprising a hollow shaft, which serves in known manner to produce different unwinding conditions of the yarn on a two-for-one twisting spindle. The present upper adapter portion 5' is a lubricating head 50, which forms a yarn inlet end and moistens the yarn passing therethrough with a finishing agent.

Figure 5:
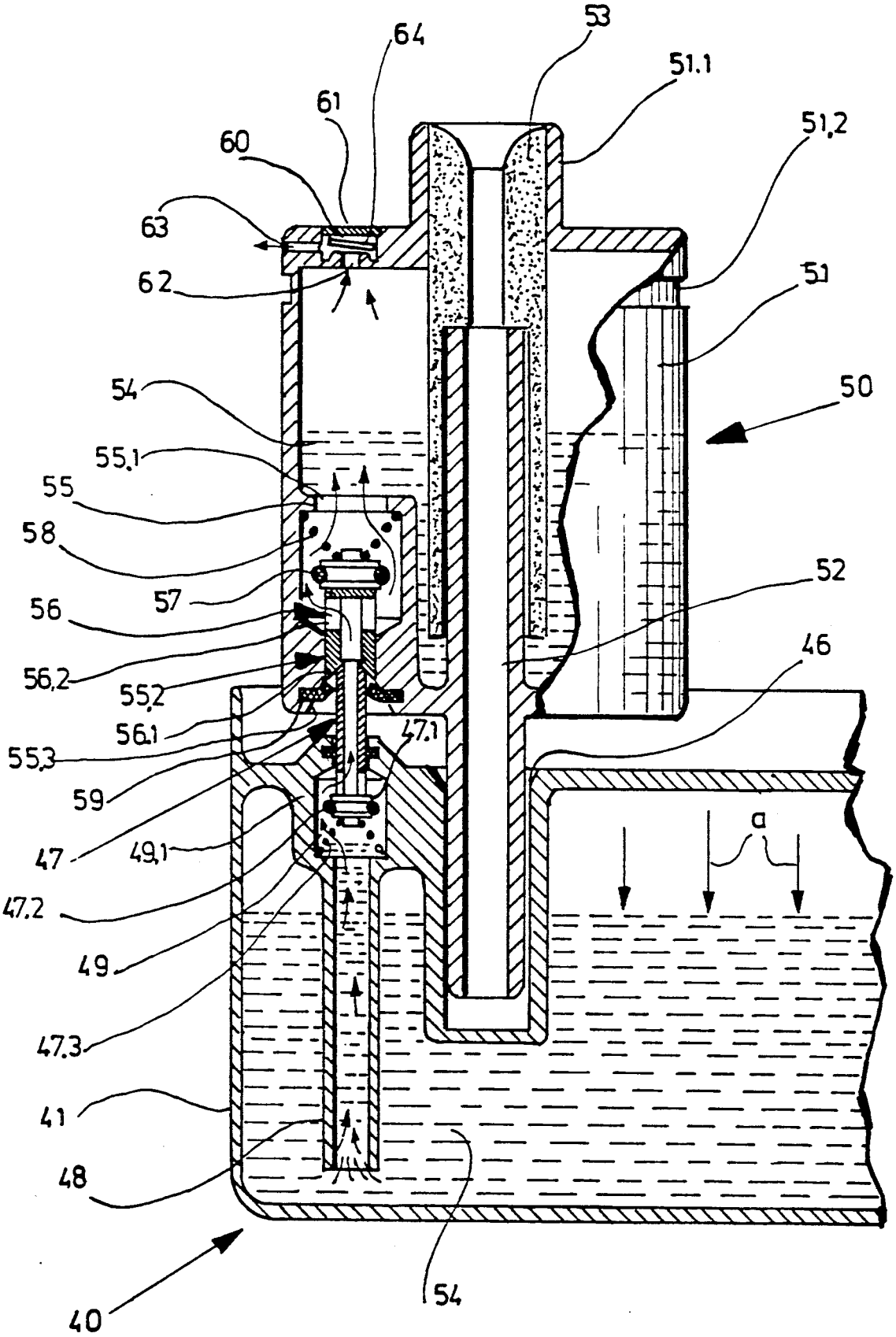
FIG. 5 is a sectional view of portions of a refilling station integrated in the maintenance automat with a correspondingly constructed lubricating head of a two-for-one twisting spindle.

As shown in FIG. 5, the lubricating head 50 comprises an annular tank 51, the upper side of which is closed, if need be by a removable cover. A central tube 52 extends through the bottom of the tank 51, which can be inserted with its end projecting downward from the tank $1 and extending inside a two-for-one twisting spindle along the extension of the hollow spindle shaft, into the hollow shaft of the lower package adapter 5, as is shown in FIG. 3. The upper side or the cover of the tank 51 is provided with an outward directed, central tubular extension 51.1, into which a wetting body 53 in the form of an annular, rigid body of rotation of a porous material with a capillary action is inserted. The side of the wetting body 53, which faces the yarn, has an inward directed, spherical surface. The tubular wetting body is inserted with its lower portion on the portion of the central tube 52 located inside the tank 51. A lubricating or wetting agent 54, which is filled into the tank 51, is transported upward by capillary action, as long as the wetting body 53 is immersed therein, thereby moistening the yarns with the wetting agent as they pass along the spherical surface of the wetting body 53. In so doing, the supply of the wetting agent inside the tank 51 is consumed, so that it becomes necessary to refill the wetting agent from time to time.

To this end, the tank 51 is provided with an inner refilling chamber 55, which comprises at its upper side an opening 55.1 and at its bottom a downward directed, cylindrical bore 55.2, which merges into an outward flaring conical opening 55.3. Inserted into the cylindrical bore 55.2 is a valve body 56 with an annular seal 57, which is slidably guided with its downward directed hollow cylinder shaft 56.1 in the cylindrical bore 55.2. The hollow cylinder shaft is provided with lateral openings 56.2 in the region of its upper end. The valve body 56 is biased by a return and locking spring 58 abutting on the upper side of the refilling chamber 55, in such a manner, that it lies with its annular seal 57 against the bottom of the refilling chamber 55 forming a valve seat. Inserted into the conical opening 55.3 is an annular lip seal 59. The upper wall or cover of the tank 51 is provided with a blind bore 60 closed by a plug 61 and having a larger diameter, which is followed by a passageway 62 leading into the interior of the chamber and having a smaller diameter. A transverse bore 63 terminates in the blind bore 62. The passageway 62 is surrounded on its upper end with an annular shoulder, on which a valve flap 64 is located.

FIG. 2 is a cross sectional view of a portion of the two-for-one twister, comprising a machine frame 27, a compressed-air line 28 with a connection 29 leading to a two-for-one twisting spindle and to a nozzle 30 for a pneumatic threadup of the yarn, and a spindle whorl 31 with a belt pressure roll 32 for pressing a tangential belt 33 against the spindle whorl 31. A foot pedal 34 associated to each individual spindle serves to actuate a spindle brake not shown, and to actuate likewise the compressed-air nozzle 30, so as to build up in known manner a suction air current in the hollow spindle shaft for the purpose of threading the yarn through the spindle.

FIG. 2 also shows portions of the maintenance automat B patrolling in front of the two-for-one twister on rails 1 and 2. These portions include detail views of the servicing and handling elements relevant for the further description, such as the grippers 22 and 37 and the suction device 23, as well as an actuation lever 35, which when being depressed in direction of arrow f6 at a given moment, allows to actuate the pedal 34 for a shutdown of the individual spindles. FIG. 2 illustrates shortly above the pedal 34 two track rolls 36 of the maintenance automat B, which are guided along a surface 1.1 of the lower rail 1.

The suction device 23 with the upper gripper 37 is mounted on a pivot arm 23.1 and adapted to rotate likewise in direction of arrow f1 as the gripper 22, and to move upward and downward in vertical direction as indicated by arrow f6.

As to FIG. 2, mention should be made that, once the suction device 23 is swung into the region of the spindle axis, the balloon yarn guide 10 is moved out of its position coaxial with the spindle.

FIG. 3 illustrates the lower gripper 22 as it grasps with its two arms 22.1 and 22.2 the lower adapter portion 5, thereby clamping simultaneously the yarn end extending to the tube 6' still holding a residual yarn wind.

The lubricating head 50 is grasped and held by the upper gripper 37, which is attached to the suction device 23 and comprises two horizontally rotatable arms 37.1 and 37.2. The arms 37.1 and 37.2 of the upper gripper 37 are provided with inward directed projections or noses 38, which engage in point contact with an annular groove 50.2 of the lubricating head 50, thereby ensuring that a yarn guided on the outside of the lubricating head 50 and entering from top into the center or the hollow shaft of the lubricating head, is not clamped by these gripper arms 37.1 and 37.2.

Integrated in the lower gripper 22 or respectively its arms 22.1 and 22.2 as well as in suction device 23 are air channels, through which air can be supplied for a pneumatic actuation of either the gripper arms or cutting devices not shown, or which allow to build up suction air currents for the removal of cut yarn ends.

Once the condition shown in FIG. 3 is reached, the suction device 23 together with the upper gripper 37 is moved sideways. Thereafter, it is possible to lift the lower adapter portion 5 together with tubes 6' out of the protective pot 8. The gripper 22 then retracts into the maintenance automat B so far that the lower adapter portion 5 with the tubes 6' can be inserted on one of the two mandrels 100, which has moved to a corresponding rotated position.

Figure 4:
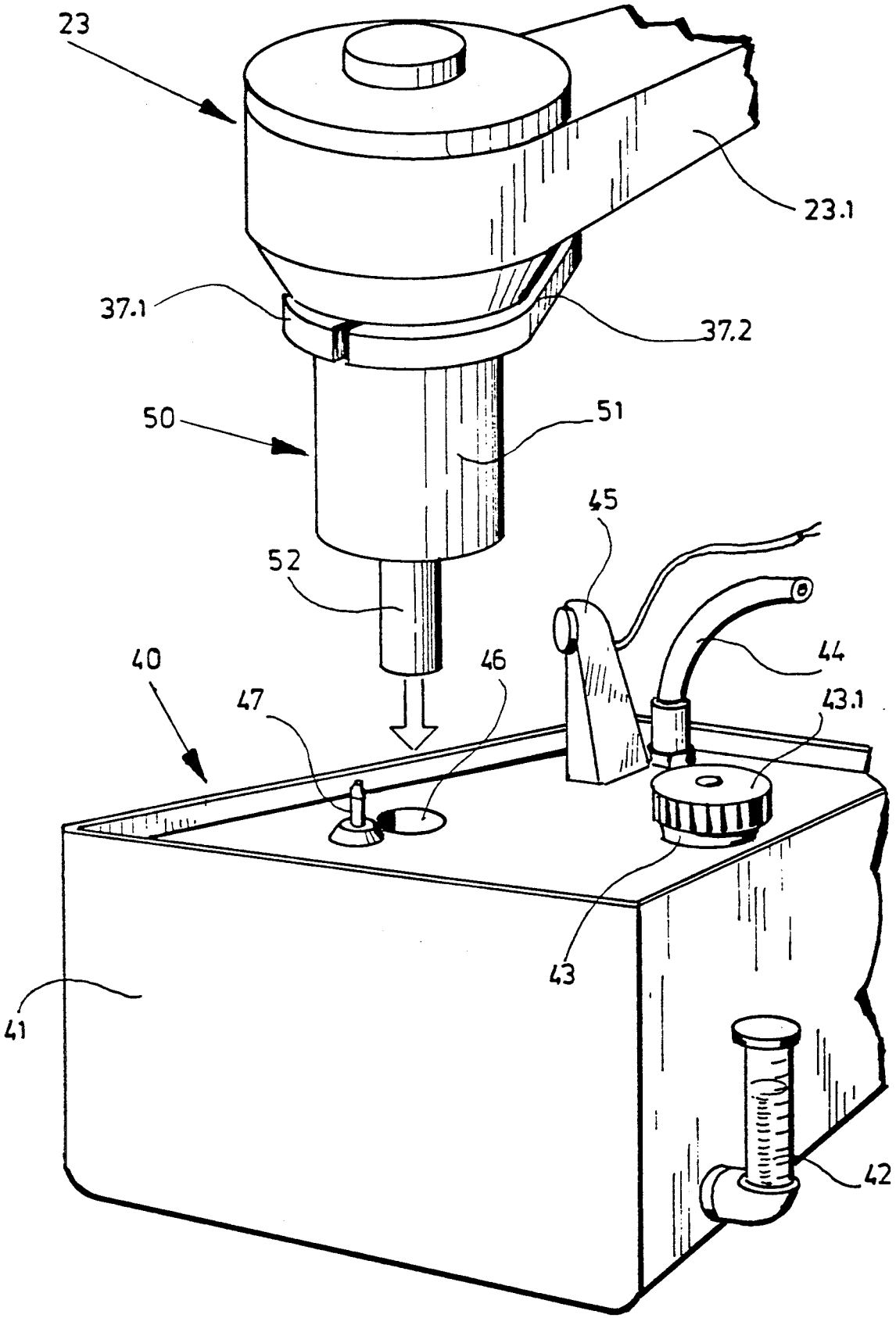
FIG. 4 is a perspective view of portions of a refilling station arranged inside the maintenance automat.

In order to refill a wetting agent into the lubricating head 50 or its tank 51, the lubricating head 50 held by the gripper 57 is moved into the maintenance automat B to a position above a refilling station 40, which is shown in FIG. 4. The refilling station 40 comprises a storage tank 41 for a wetting agent 54, which forms a part of the maintenance automat B. This storage tank 41 includes a fluid gauge 42, a filler inlet end 43 covered by a cap 43.1, a compressed-air connection 44, a sensor 45 to measure the fluid level in the storage tank 41, a receptacle 46 to insert tubular connecting member 52 extending downward from the tank of the lubricating head 50, as well as a filler tube 47 projecting upwardly from the storage tank 41.

Inside the storage tank 41 is a tubular member 48, which terminates with its lower, open end above the bottom of the tank, and with its upper end in a valve chamber 49, which is arranged below the upper wall of the storage tank 41 and connected with the surrounding atmosphere via a bore 49.1. Sealably inserted into this bore 49.1 is the filler tube 47, which carries on its end inside the valve chamber 49 a valve plate 47.1 with an annular seal 47.2. The filler tube 47 is provided with lateral openings directly above the valve plate 47.1. The valve plate 47.1 is biased by a locking or return spring 47.3, which presses the valve plate or its seal against the valve seat formed by the upper side of the valve chamber 49.

The arrows a in FIG. 5 indicate that an overpressure exists inside the storage tank 41, which is decreased by compressed air supplied through the connecting inlet 44, and ensures in addition to spring 47.3 that the filler tube 47 is closed.

At the same time as the tube 52 of the lubricating head 50 is inserted into the receptacle 46, the filler tube 47 moves into the conical opening 55.3, so that the upper end of the filler tube, which is preferably conically tapered, is pushed against the underside of the hollow cylinder shaft 56.1, which has preferably a funnel-shaped opening. As the lubricating head 50 is further lowered, the filler tube 47 raises the valve body 56 of the lubricating head 50 from its seat against the force of compression spring 58, so that the lateral openings 56.2 produce a connection between the refilling chamber 55 and the inner bore of the cylinder shaft 56.1. As the lubricating head 50 is still further lowered, the filler tube 47 enters further into the bottom of the storage tank 51 against the force of the return and locking spring 58. This return and locking spring 58 is so designed that is exerts, effective a certain point along the path, so much counterpressure on the filler tube 47, that same evades downward against the force of its supporting spring 47.3, thereby opening it associated valve. The overpressure existing in the storage tank 41 now permits the wetting agent 54 to flow from the storage tank 41 into the tank 51.

The Wetting agent flowing into the storage tank 51 displaces the air above the level of the wetting or finishing agent, which can flow out via a relief valve of the tank 51 formed by the elements 60, 61, 62, 63, and 64.

As soon as the lubricating head is raised from the storage tank 41, the two valves close by the action of their return and locking springs 58 and 47.3 respectively. Subsequently, the refilled lubricating head 50 can be returned to the region of the spindle and reinserted on the lower adapter portion 5, which has meanwhile been returned into the spindle loaded with two full cross-wound packages or feed yarn units 6.

After the suction device 23 with its associated gripper arm 37 and the lower gripper 22 are returned into the maintenance automat B, the spindle is ready for another twisting cycle.

What is claimed is:

1. In a textile yarn processing machine having a plurality of spindle assembly stations in side-by-side relationship along the length of the machine for processing of yarn at each station and each of said stations including an adapter device carrying at least one yarn supply package and being removably mounted along the spindle assembly axis for supplying yarn to be processed and a yarn lubricating head device removably mounted on said adapter device along the spindle assembly axis and having a storage tank for containing a lubricating agent and a porous wetting body extending into said tank for absorbing the lubricating agent by capillary action and being positioned for receiving the yarn as it is being processed and applying the lubricating agent to the yarn, and a maintenance device for traveling to a respective spindle assembly station after a supply package of yarn has been processed, removing said adapter device with a substantially empty yarn supply package thereon from said spindle assembly station and placing one of said adapter devices with a full yarn supply package in said spindle assembly station for subsequent yarn processing; the improvement of means positioned within said maintenance device for refilling said storage tank of each of said lubricating head device at the respective spindle assembly station when said maintenance device travels to the respective spindle assembly station; and means carried by said maintenance device for removing said lubricating head device from said adapter device, carrying said lubricating head device into said maintenance device and positioning said lubricating head device in said refilling means, and for subsequently removing said lubricating head device from said refilling means after refilling thereof, carrying said lubricating head device to said spindle assembly station and positioning said lubricating head device on said adapter device.

2. In a textile yarn processing machine, as set forth in claim 1, in which said refilling means includes a supply tank means for containing lubricating agent and valve means opening into said supply tank, and in which said lubricating head device further includes valve means opening into said storage tank and for cooperating with said valve means of said refilling means for allowing the flow of lubricating agent from said supply tank to said storage tank.

3. In a textile yarn processing machine, as set forth in claim 2, in which said valve means of said refilling means and said valve means of said lubricating head device include respective male ;and female valve members in the form of a movably mounted protruding tube in said refilling means valve means and movably mounted hollow member in said lubricating head device valve means.

4. In a textile yarn processing machine, as set forth in claim 3, in which said valve means of said refilling means and said valve means of said lubricating head device each includes spring means biasing said respective male and female valve members into their closed positions.

5. In a textile yarn processing machine, as set forth in claim 2, 3 or 4, in which said refilling means includes a compressed-air inlet means on said supply tanks for receiving compressed air to pressurize the lubricating agent in said supply tank.

6. In a textile yarn processing machine, as set forth in claim 1, 2, 3 or 4, in which said lubricating head device includes a pressure relief valve on said storage tank for relieving pressure, in said storage tank during filling thereof.

7. In a textile yarn processing machine, as set forth in claim 1, 2 or 4, in which said lubricating head device and said refilling means further include cooperating mounting guide means for mounting said lubricating head device in desired position on said refilling means.

8. In a textile yarn processing machine, as set forth in claim 7, in which said cooperating mounting guide means comprise a connecting tube means extending from said lubricating head device and a complementary receptacle in said refilling means for receiving said connecting tube means.

* * * * *